United States Patent [19]

Johnson

[11] 4,335,550

[45] Jun. 22, 1982

[54] PRIME WINDOW UNIT INSTALLATION SYSTEM

[76] Inventor: David P. Johnson, 5660 Marcy St., Omaha, Nebr. 68106

[21] Appl. No.: 218,215

[22] Filed: Dec. 19, 1980

[51] Int. Cl.[3] ..... E04C 1/12; E04B 1/08

[52] U.S. Cl. ..... 52/99; 52/204; 52/656

[58] Field of Search ..... 52/99, 204, 205, 207, 52/208, 211, 213, 762, 763, 210, 215, 217, 656; 49/62, 504, 505

[56] References Cited

U.S. PATENT DOCUMENTS

| | | | |
|---|---|---|---|
| 2,629,143 | 2/1953 | Spector et al. | 49/62 |
| 2,841,835 | 7/1958 | Nardulli | 52/656 |
| 3,583,114 | 6/1971 | Belfor | 52/217 |
| 3,604,155 | 9/1971 | Brown | 49/504 |
| 4,250,673 | 2/1981 | Hubbard | 52/217 |
| 4,272,931 | 6/1981 | Stanizzo | 52/217 |

FOREIGN PATENT DOCUMENTS

| | | | |
|---|---|---|---|
| 952909 | 3/1964 | United Kingdom | 52/207 |

*Primary Examiner*—James L. Ridgill, Jr.

*Attorney, Agent, or Firm*—Zarley, McKee, Thomte, Voorhees & Sease

[57] ABSTRACT

An adjustable window installation frame for installing a new prime window unit in an existing window unit opening includes a top channel, bottom channel and opposite side channels. The bottom channel and side channels are connected to the new sill and new side jambs of a new prime window unit and the top channel is extended between the upper ends of the side channels. Each channel includes an inner wall extending exteriorly of the new prime window unit for recessing it relative to the frame and an outer wall extending outwardly from the new prime window unit. The outer walls are provided with a plurality of spaced apart slots for reducing the width of the channels to fit various window sizes.

The method of the invention includes connecting the bottom channel and side channels to the sill and side jambs of a new prime window unit, connecting the top channel across the upper ends of the side channels and placing the preassembled new window unit and channels into a window unit opening.

19 Claims, 15 Drawing Figures

PRIME WINDOW UNIT INSTALLATION SYSTEM

BACKGROUND OF THE INVENTION

The present invention is directed generally to the installation of new prime window units and more particularly to a system for installing manufacturer's stock window sizes into old window frames.

There is considerable business in the field of installing new prime window units in old window openings. This is done both for remodeling and to improve the insulation characteristics of old window openings for energy saving purposes. A typical example would be the installation of all new windows in an old school building.

In the past, it was the practice to build out the old window frame to create an opening of precise size for receiving a new prime window unit. This was done by framing out from the old window frame to support the new window unit and then convering the new framing and old window frame with trim members. Accordingly, the exterior surfaces of the new window unit and old window frame were aligned in the same plane so that the useful flat trim members would lie flush with both of them. The resulting nonrecessed installation often had the unfinished appearance of a smaller new window unit simply patched into a larger window opening.

Another problem with this existing window replacement practice is the considerable amount of time and labor necessarily required at the job site. This is because the new framing is first fastened to the old window frame before the new window unit is installed. Finally, the trim members are added to complete the custom installation of each new window unit. Such installations often involve substantial labor costs and may interfere with the normal use of the building for substantial periods of time.

A known alternative to the above described practice is an almost completely custom window replacement system wherein the parts are custom sized for each installation. In spite of the many advantages of this system, its use is limited by its practically prohibitive cost.

Accordingly, it is an object of the present invention to provide an improved system for installing a new prime window unit in an existing window opening.

Another object is to provide such a system wherein the time and labor required at the job site for a given installation is minimized.

Another object is to provide such a system wherein the exterior window framing may be fastened to the new window unit prior to installation into an existing window opening.

Another object is to provide such a system including a minimum number of stock parts which are readily adaptable for use in installing various sizes of new prime window units in various sizes of existing window openings.

Another object is to provide such a system wherein the new prime window unit is substantially supported by the exterior trim channels therefor.

Another object is to provide such a system which would allow for adjustment of the new prime window unit in an interior-exterior direction for easier and less expensive trimming of the interior surface.

Finally, an object is to provide such a system which is economical to manufacture, simple in construction, easy to install, efficient in operation and refined in appearance.

These and other objects will be apparent to those skilled in the art from the following description.

DESCRIPTION OF THE PREFERRED EMBODIMENT

Figure 1:
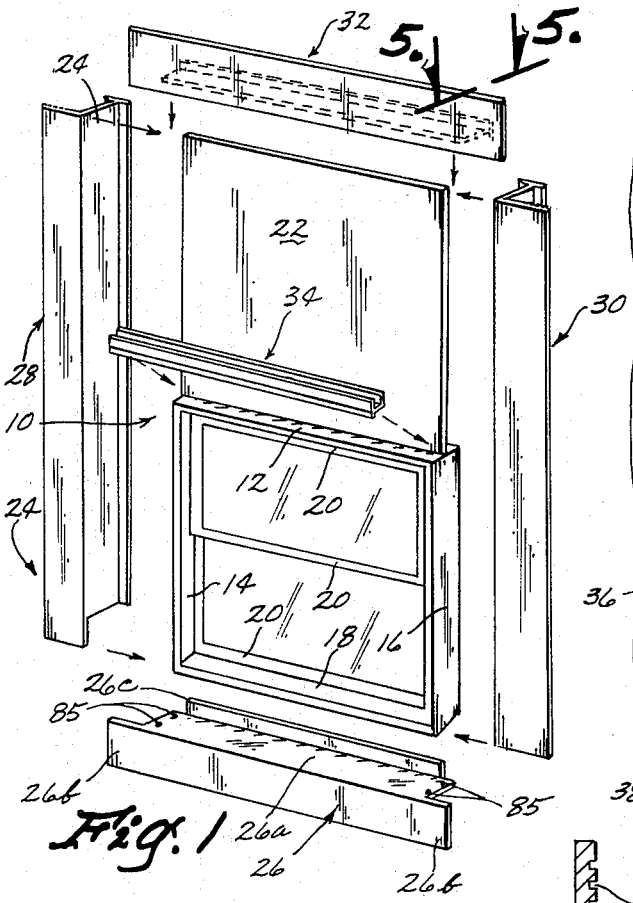
FIG. 1 is an exploded perspective view of the adjustable window installation frame in relation to a double hung window unit with an overhead filler panel.

There is shown in FIG. 1 a new prime window unit 10 which includes a new head jamb 12, side jambs 14 and 16, sill 18 and sash 20. Whereas new prime window unit 10 is shown as a double hung window unit, it is to be understood that the adjustable installation framing of the present invention is similarly operative for installing casement, awning and horizontal sliding type window units. A filler panel 22 closes the space between the new window unit 10 and the top of a taller window opening.

The adjustable window installation frame of the present invention, referred to generally at 24, includes an elongated generally inverted L-section bottom channel 26, a pair of elongated generally L-section side channels 28 and 30 and an elongated generally L-section top channel 32. A panel retainer strip 34 is included for supporting the filler panel 22.

Figure 2:
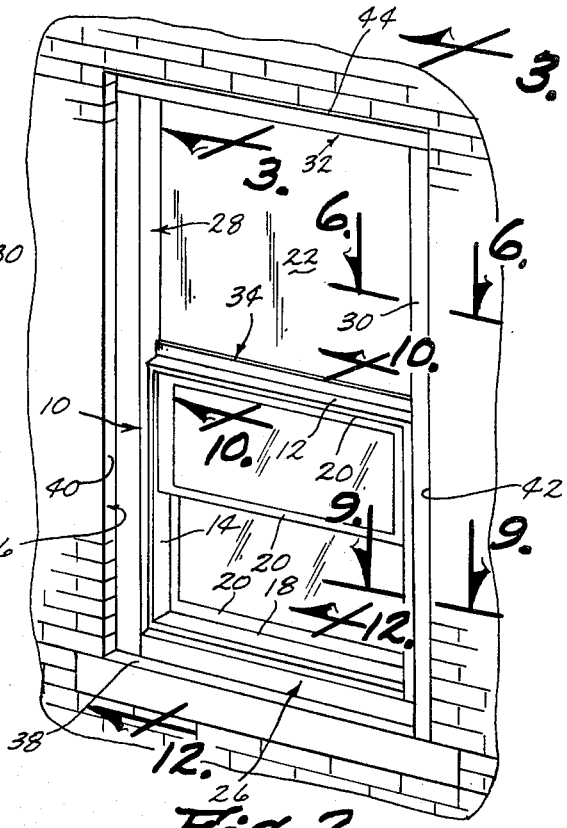
FIG. 2 is a front elevational view of the adjustable window installation frame in assembly relation with a double hung window and overhead filler panel in an existing window opening.

FIG. 2 and the various sectional view indicated therein show the new prime window unit 10 fully installed within an existing window unit opening 36. In the embodiment shown, opening 36 is defined by a stone sill 38, brick side walls 40 and 42 and a top lintel 44.

In the following description, "exterior" and "interior" shall refer to directions generally perpendicular to the plane of the new window unit. "Inward" and "outward" will refer to directions generally within or parallel to the plane of the new window unit.

The L-section shape of each of the channels is formed by inner and outer flanges designated by the letters a and b following the reference numeral for that channel. Thus the inner flanges 26*a*, 28*a*, 30*a* and 32*a* are directed exteriorly of the new window unit 10 and the outer flanges 26*b*, 28*b*, 30*b* and 32*b* are extended outwardly from the exterior edge of the respective inner flanges. Likewise, a small inwardly directed installation flange 26*c*, 28*c*, 30*c* and 32*c* extends inwardly from the inner flange of each channel at a position interiorly of the outer flange.

Figure 3:
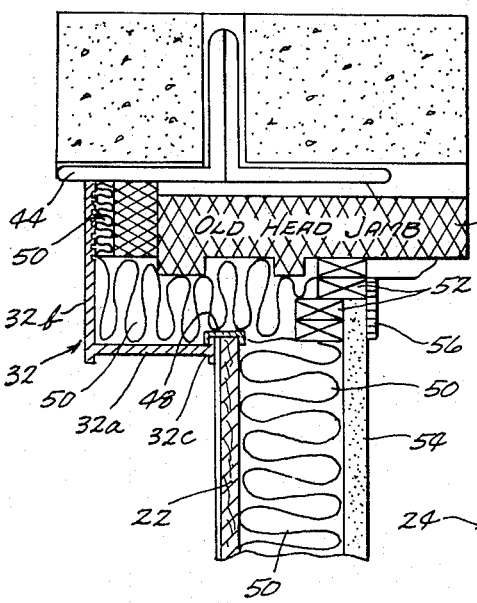
FIG. 3 is an enlarged sectional view taken along line 3—3 in FIG. 2.

Referring to FIG. 3, it is seen that the new window unit 10 is installed without disturbing the old window frame of which the old head jamb 46 is a part. Top channel 32 is placed with its installation flange 32*a* lying flush against the top edge of the front surface of filler panel 22. A plurality of U-shaped clips 48 connect the top channel 32 and filler panel 22. In the installed position of the top channel 32 and filler panel 22, insulation material 50 fills the space between these members and the existing frame. In addition, framing strips 52 are fastened onto the old head jamb 46 for providing structural support for interior sheet rock 54, the edge of which may be concealed by a trim board 56. The insulation material 50 also fills the space between the filler panel 22 and sheet rock 54.

Figure 4:
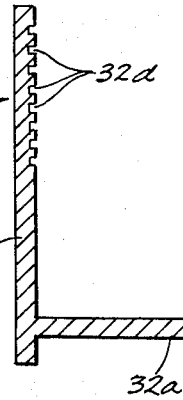
FIG. 4 is a further enlarged transverse sectional view of the top channel.

FIG. 4 shows the cross sectional shape of top channel 32. It is seen that the vertical outer flange 32*b* extends slightly below the horizontal inner flange 32*a* to prevent drainage of water across the inner flange towards the window unit. Installation flange 32*c* is tapered to a point at its inward end as indicated at 58.

Figure 5:
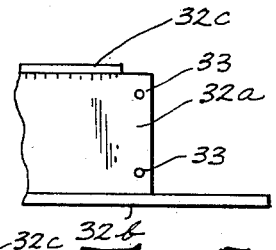
FIG. 5 is a partial top view of one end of the top channel.

In FIG. 5, it is seen that inner flange 32*a* is recessed inwardly of the end of the outer flange 32*b* and that installation flange 32*c* is recessed further inwardly for receiving the side channel 30 as explained hereinbelow. Screw holes 33 also accommodate coupling to side channel 30.

Figure 6:
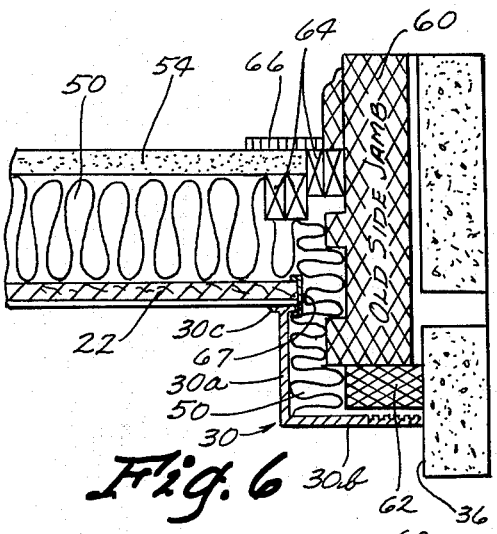
FIG. 6 is an enlarged sectional view taken along line 6—6 in FIG. 2.

FIG. 6 shows the relationship of the filler panel 22 and side channel 30 to the old side jamb 60 and brick side wall 42 of window unit opening 36. Again, insulation material 50 fills the space between these members and the existing frame including the old trim boards 62. Framing strips 64 support the side of the sheet rock 54 which is bordered by trim board 66. U-shaped clips 67 connect the side channel 30 and filler panel 22.

Figure 7:
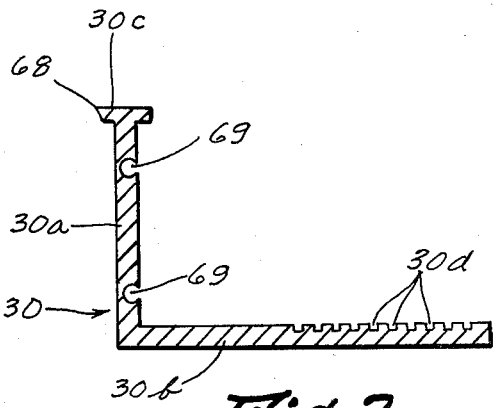
FIG. 7 is a further enlarged transverse sectional view of the side channel.

FIG. 7 shows the cross sectional shape of side channel 30, it being understood that side channel 28 is of identical cross sectional shape. The inward end of installation flange 30*c* tapers inwardly and interiorly as at 68. A plurality of longitudinally extended and transversely spaced apart weakened portions in the form of slots 30*d* are formed in the interior surface of outer flange 30*b* for a purpose described hereinbelow. A pair of C-section screw slots 69 are formed in the inner flange 30*a* for accepting screws inserted through holes 33 (FIG. 5) of top channel 32 for securely coupling the top and side channels together.

Figure 8:
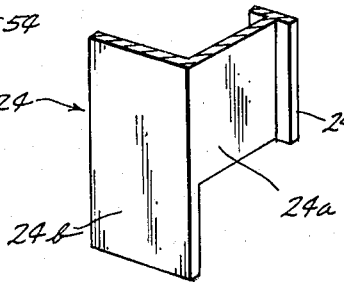
FIG. 8 is a partial perspective view of the lower end of one side channel.

FIG. 8 shows that the inner flange 30*a* and installation flange 30*c* are recessed above the lower edge of outer flange 30*b* to accommodate the joint with sill channel 26.

Figure 9:
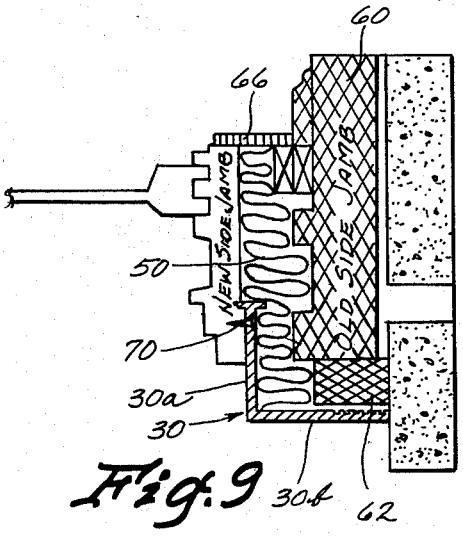
FIG. 9 is a sectional view taken along line 9—9 in FIG. 2.

FIG. 9 shows the connection of side channel 30 with the new side jamb 16. Installation flange 30*c* is inserted within a longitudinally extended installation slot 16*c* in the outward surface of side jamb 16. Several vertically spaced apart holes would be drilled in the inner flange 30*a* to receive screws 70 for securing the inner flange in flush engagement against the outward surface of side jamb 16.

Figure 10:
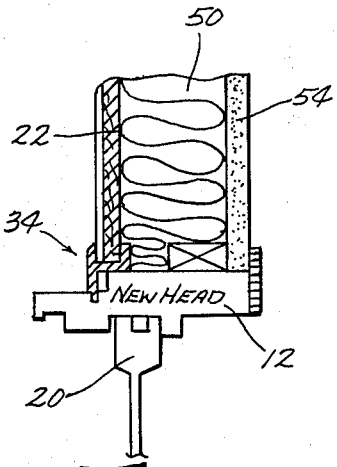
FIG. 10 is an enlarged sectional view taken along line 10—10 in FIG. 2.
Figure 11:
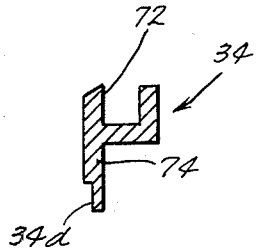
FIG. 11 is a further enlarged transverse sectional view of the panel retainer.

In FIG. 10, it is seen how the filler panel 22 is supported on the new head jamb 12 by means of the panel retainer strip 34. Panel retainer 34 includes an inverted U-shaped channel portion 72 having an interior width adapted for receiving the filler panel 22. A depending flange 74 along the exterior side of the retainer has a reduced thickness installation flange 34*d* at its lower end which is adapted for insertion into the cooperating installation slot 12*c* in the top side of new head jamb 12. FIG. 11 shows the cross sectional shape of panel retainer 34.

Figure 12:
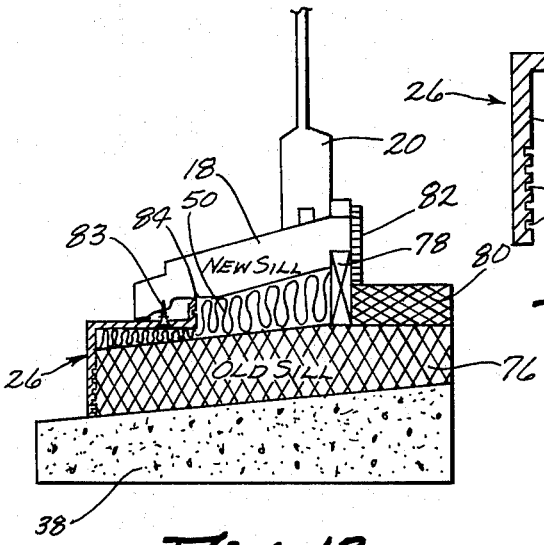
FIG. 12 is an enlarged sectional view taken along line 12—12 in FIG. 2.

FIG. 12 shows the installation of the new sill 18 and bottom channel 26 in relation to the old sill 76 and stone sill 38 of window opening 36. The installation flange 26*c* of sill channel 18 is inserted within a cooperating installation slot 18*c* in the bottom side of sill 18. In the embodiment shown, outer flange 26*b* is engaged flush against the exterior surface of old sill 76. That is a convenient way to position bottom channel 26 but is not critical to the present invention. A frame board 78 underlies the interior edge of new sill 18 and insulation material 50 fills the space between the new and old sill 18 and 76. Frame board 78 abuts against the existing stool 80 and a trim piece 82 covers the interior surface of new sill 18.

Figure 13:
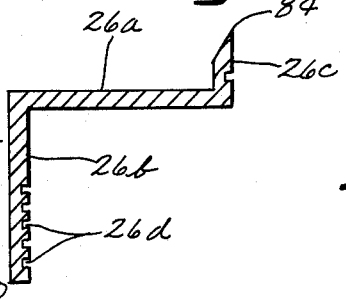
FIG. 13 is a further enlarged transverse sectional view of the bottom channel.

The cross sectional shape of bottom channel 26 can be seen in greater detail in FIG. 13 wherein it is seen that the installation flange 26*c* tapers to a point at 84 and the outer flange 26*b* includes the longitudinally extended and transversely spaced apart slot 26*d* in the interior face thereof.

Figure 14:
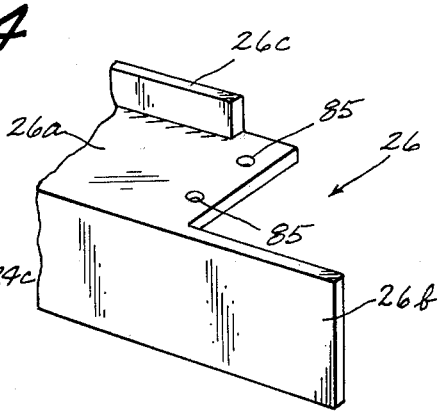
FIG. 14 is a partial perspective view of one end of the bottom channel.

FIG. 14 shows that the finished end of bottom channel 26 has the inner flange 26*a* recessed inwardly of the end of outer flange 26*b* and the installation flange 26*c* is recessed further inwardly of the end of the inner flange 26*a*. Screw holes 85 in the inner flange 26*a* enable the insertion of screws into slots 69 (FIG. 7) of side channel 30 for coupling the bottom and side channel together.

In operation, the various channels of the adjustable installation frame 24 are screwed to the new prime window unit 10 before it is installed in the old opening 36. Preferably, the top and bottom channels 32 and 26 will be provided in stock window size dimensions. The side channels 28 and 30 can then be cut off at the top for major height variations. Screws inserted through the top and bottom channels into the C-section screw slots 69 in the side channels couple these channels together as a rigid assembly. The slots or notches 26*d*, 28*d*, 30*d* and 32*d* on the interior side of the outer flanges of the respective channels provide a break-off capability for smaller dimensional variations. Assuming the channels are formed of extruded aluminum, the outermost portion of an outer flange can be broken off uniformly along its length by simply bending the flange along one of the slots. This features enables standard channel sections to be readily adaptable for somewhat customized close fit installation in window unit openings of various sizes.

Furthermore, the new installation frame 24 can be shimmed out from the old window frame to allow for variations in the old window jamb thickness. This is largely accounted for by the fact that the outer flanges 26*b*, 28*b*, 30*b* and 32*b* of the respective channels need not abut against the adjacent portion of the old window frame but rather can independently support the new prime window unit at various positions relative to the old window frame.

The fact that the channels 26, 28, 30 and 32 may be secured to the new prime window unit 10 prior to installation into the window unit opening 36 can save considerable time and labor at the job site. The fact that the channels fully support the new prime window unit within the window opening saves additional time and expense associated with the framing operations which are therefore eliminated.

An important consideration in the installation of new prime window units is the aesthetic appearance of the finished installation. In the present invention, the new prime window unit is recessed interiorly of the outer flanges of the channels which thereby provide an attractive framing for the window. The framing gives the appearance of a more permanent and secure installation.

Figure 15:
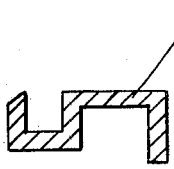
FIG. 15 is a transverse sectional view of an alternate panel retainer.

Whereas a preferred embodiment of the invention has been shown and described herein, it will be apparent that many modifications, variations and substitutions may be made which come within the intended broad scope of the appended claims. For example, various shaped channels other than the L-section shape shown herein may be used so long as such shape includes inner and outer walls which extend exteriorly and outwardly from the window unit respectively. Instead of the panel retainer strip 34 shown in FIG. 11, the alternate panel retainer strip 86 of FIG. 15 may be used for some casement windows and for an opening which is to be completely closed by paneling alone.

The present invention is also readily adaptable for use in certain window openings having an arcuate circle head. For relatively shallow designs, the arc can simply be cut into the outer flange 32*b* of top channel 32. For deeper designs such as a semi-circle, the filler panel 22 may be simply cut to conform to the arcuate border at the top of the window unit opening.

Thus there has been shown and described a system for installing a new prime window unit in an existing opening which accomplishes at least all of the stated objects.

I claim:

1. A new prime window unit assembly for installation in an existing window unit opening having an existing window frame installed therein, comprising, a new prime window unit including a new head jamb, side jambs, sill and sash, an elongated bottom channel, a pair of elongated side channels having upper and lower ends, an elongated top channel, said channels comprising separate independent members adapted for connection to said new prime window unit, fastening means securing said bottom channel and side channels to said new sill and side jambs respectively, said top channel being connected to and extended between the upper ends of said side channels, each of said channels including an inner wall and an outer wall, said inner wall extending exteriorly of said new prime window unit thereby to recess said new prime window unit interiorly of said outer wall, and said outer wall extending outwardly from said inner wall, each of said channels including means for selectively reducing the outward extent of the outer wall thereof uniformly along the length of said outer wall, and said new prime window unit assembly being preassembled for installation as a unit in said existing window unit opening.

2. The frame of claim 1 wherein said new head jamb, side jambs and sill have longitudinally extended installation slots in the outward sides thereof and each of said channels further comprises an inwardly directed installation flange on the inner wall thereof, said installation flanges being adapted for insertion into said installation slots.

3. The frame of claim 1 wherein each of said channels has a generally L-section shape and said inner and outer walls comprise respective inner and outer flanges of said L-section channel.

4. The adjustable window installation frame of claim 1 further comprising a filler panel, an elongated panel retainer adapted to support the bottom edge of said filler panel, means for connecting said panel retainer to the top side of said new head jamb, and means for connecting the top edge of said filler panel to said top channel.

5. The adjustable window installation frame of claim 4 further comprising means for connecting opposite sides of said filler panel to said pair of side channels.

6. The frame of claim 1 wherein said means for selectively reducing the outward extent of the outer wall comprises a weakened portion of said outer wall, said weakened portion extended longitudinally of said outer wall whereby the part of said outer wall which is situated outwardly of said weakened portion may be broken off.

7. The frame of claim 6 wherein each of said channels includes a plurality of said weakened portions extended longitudinally thereof in transversely spaced-apart relation.

8. The frame of claim 7 wherein said weakened portion comprises an elongated slot on the interior side of said outer wall.

9. In combination, a wall structure having a window unit opening therein defined by a sill, opposite side walls and a top lintel, a new prime window unit including a new head jamb, side jambs, sill and sash, an elongated bottom channel, a pair of elongated side channels having upper and lower ends, a top channel, said channels comprising separate independent members adapted for connection to said new prime window unit, fastening means securing said bottom channel and side channels to said new sill and side jambs respectively, said top channel being connected to and extended between the upper ends of said side channels, each of said channels including an inner wall, and an outer wall, said inner wall extending exteriorly of said new prime window unit thereby to recess said new prime window unit interiorly of said outer wall, and said outer wall extending outwardly from said inner wall, each of said channels including means for selectively reducing the outward extent of the outer wall thereof uniformly along the length of said outer wall, whereby the height and width of said new prime window unit assembly conforms to said window unit opening, and said new prime window unit assembly being supported as a unit in said window unit opening such that substantially the entire weight of said new prime window unit assembly is borne by the outer walls of said channels.

10. The combination of claim 9 wherein said wall structure further includes an existing sill, side jambs and top jamb installed therein, said new prime window unit assembly being supported in said window unit opening in a vertical plane intersecting said existing head jamb, side jambs and sill.

11. A method of installing a new prime window unit including a new head jamb, side jambs, sill and sash in an existing window unit opening having an existing window frame installed therein, comprising, providing a bottom channel, a top channel and a pair of side channels having upper end portions, each of said channels comprising separate independent members adapted for connection to said new prime window unit, and each of said channels having inner and outer walls, connecting the bottom channel to said new sill, connecting said pair of side channels to respective ones of said new side jambs, connecting the top channel to the upper end portions of said side channels so as to extend therebetween, selectively reducing the outward extent of at least one of said channels from said new prime window unit uniformly along the length of said channel, placing said connected new prime window unit and channels said window opening, and supporting the new prime window unit in said opening on the outer walls of said channels.

12. The method of claim 11 further comprising removing the existing sash from said existing window frame and placing said connected new prime window unit and channels into said window unit and channels into said window opening in the space previously occupied by the removed sash.

13. The method of claim 10 wherein said step of selectively reducing comprises conforming the outer periphery of the connected new prime window unit and channels to the inner periphery of said window unit opening for a close fit installation of said connected new prime window unit and channels into said window unit opening.

14. The method of claim 10 further comprising recessing said new prime window unit interiorly of the outer walls of said channels.

15. The method of claim 10 wherein said new head jamb, side jambs, and sill are provided with longitudinally extended installation slots in the outward sides thereof, the inner walls of said channels being provided with inwardly directed installation flanges and further comprising inserting said installation flanges of said respective channels into said installation slots.

16. The method of claim 10 further comprising fitting a filler panel between said new prime window unit and top channel, installing a panel retainer strip on the top side of said new head jamb and supporting said filler panel on said panel retainer strip.

17. The method of claim 10 wherein the outer walls of said channels are provided with transversely spaced apart weakened areas extended along the lengths thereof, the step of selectively reducing the outward extent of said channels comprising breaking off a portion of said channels along selected ones of said weakened areas.

18. The method of claim 11 wherein said placing step comprises inserting said connected new prime window unit and channels into said window opening from the exterior side thereof.

19. The method of claim 11 wherein said placing step comprises arranging said connected new prime window unit and channels in said window opening such that substantially the entire weight of said connected new prime window unit and channels is borne by said outer walls.

* * * * *